US006868986B1

(12) United States Patent
Arnold

(10) Patent No.: US 6,868,986 B1
(45) Date of Patent: Mar. 22, 2005

(54) BOTTLED WATER PUMP

(76) Inventor: Christopher Paul Arnold, 887 Puiki Pl., Lahaina, HI (US) 96761

( * ) Notice: Subject to any disclaimer, the term of this patent is extended or adjusted under 35 U.S.C. 154(b) by 7 days.

(21) Appl. No.: 10/361,907

(22) Filed: Feb. 10, 2003

(51) Int. Cl.[7] ..... B67D 5/62
(52) U.S. Cl. ..... 222/66; 222/146.6; 222/333
(58) Field of Search ..... 222/66, 67, 64, 222/146.6, 333; 62/389, 396, 397

(56) References Cited

U.S. PATENT DOCUMENTS

| | | | | |
|---|---|---|---|---|
| 3,179,292 A | | 4/1965 | Terry | |
| 3,269,143 A | | 8/1966 | Gasparovich | |
| 3,495,612 A | | 2/1970 | Moreland, II et al. | |
| 3,653,413 A | * | 4/1972 | Sheya | 417/390 |
| 4,030,634 A | | 6/1977 | Osborn | |
| 4,153,181 A | | 5/1979 | Parker et al. | |
| 4,174,743 A | | 11/1979 | Beny et al. | |
| 4,958,747 A | * | 9/1990 | Sheets | 222/146.6 |
| 5,002,201 A | | 3/1991 | Handcock et al. | |
| 5,495,725 A | | 3/1996 | Middlemiss | |
| 5,540,355 A | | 7/1996 | Hancock et al. | |
| 5,558,256 A | * | 9/1996 | Miller et al. | 222/63 |
| 5,638,991 A | | 6/1997 | Todden et al. | |
| 5,842,603 A | | 12/1998 | Schroeder et al. | |
| 5,901,880 A | * | 5/1999 | Clarke | 222/63 |
| 6,182,863 B1 | | 2/2001 | Van Der Meer et al. | |
| 6,209,753 B1 | * | 4/2001 | Ohu | 222/64 |
| 6,443,334 B1 | * | 9/2002 | John et al. | 222/333 |
| 6,453,955 B1 | * | 9/2002 | Lee | 222/66 |

* cited by examiner

*Primary Examiner*—Kenneth Bomberg
(74) *Attorney, Agent, or Firm*—Michael I. Kroll

(57) ABSTRACT

The present invention 10 discloses a pump 24 system that can be added to an existing water cooler 16 or be an integral system. A power switch 34 provides means to turn the pump 24 on and off. Pump 24 controls include the low-level switch 26, the high water switch 28, and an over flow switch 30. The water bottle 15 is connected to the pump 24 by means of a wand 54 and intake line 38 which includes an accordion pump 36 to prime the line and protect against air lock. Additional elements of the present invention include an auxiliary water tap 62, an audio alert(s), a reserve battery pack 72 and a free-floating mercury switch 74 to replace the low and high level switch 26, 28.

9 Claims, 13 Drawing Sheets

BOTTLED WATER PUMP

FIELD OF THE INVENTION

The present invention relates generally to pumps, more specifically, to a pump system designed for dispensing bottled water into a water cooler reservoir.

It has been estimated that some 20% of Americans are exposed to substandard drinking water. (Environmental Nutrition magazine) In addition, it is estimated that 50 million Americans—roughly one in five—are exposed to potentially harmful levels of hazardous materials whenever they open a faucet (Sell magazine). Simply, U.S. water treatment systems are old and outdated. To upgrade the nation's outdated and sub-standard drinking water treatment systems and to bring these systems up to modern standards would have a huge financial impact and would take a considerable amount of time.

Scientists are looking at a variety of treatments to prevent contamination of public drinking water. Chlorine is the preferred treatment used by cities to control harmful bacteria and water-borne parasites in public drinking water. But when chlorine reacts with organic compounds in the water, it produces trihalomethanes, which may cause cancer. Ironically, cryptosporidium, a microscopic parasite that can cause serious illness or even death, is resistant to chlorine.

Due to these health concerns and obstacles of upgrading drinking water treatment systems, bottled water has greatly increased in use and consumption. The bottled water cooler systems used today include their own obstacles and health concerns that the present invention overcomes.

Unlike the conventional water cooler that requires the large heavy bottle of water to be lifted, inverted and emptied over the cooler reservoir, the present invention utilizes a pumping system that allows the water bottle to remain on the floor in a desired location. The present invention limits the possibility of muscle sprains and pulls associated with lifting heavy objects. The prevent invention also provides means to prevent unnecessary spillage of the water when the water bottle is inverted.

The present invention pump system can be added to an existing water cooler or be an integral system that includes the water reservoir, cooling and pumping systems.

When added to an existing water cooler system the base of the present invention is placed over the water cooler reservoir. A gasket provides means to seal the top of the water cooler reservoir and prevent possible contamination.

The present invention requires electrical power to enable the pump. A power switch provides means to turn the pump on and off.

Float switches within the present invention control the water flow into the water cooler reservoir. The low-level float switch is positioned at a desired level in the water cooler reservoir to prevent water run out. When the water level in the water cooler reservoir is below the low-level float switch the pump is turned on, upon reaching the high water switch, the pump is turned off.

The present invention also has means to protect against water over flow. In event of the high water switch malfunctioning, an over flow switch is utilized as a safety mechanism to shut off the pump.

The water bottle is connected to the pump by means of a wand and intake line. The intake line includes an accordion pump to prime the line and protect against air lock. A plug, tapered to fit the various sizes of water bottle openings, is affixed to the top opening of the water bottle. The plug provides a seal to protect the water from contamination. An air valve is contained within the plug to provide air displacement when the water is withdrawn. A second aperture in the plug allows the wand to be inserted through the plug to a depth just above the bottom of the bottle. A no water flow switch located at the end of the wand shuts the pump upon no water indicating an empty water bottle. The opposite end of the wand includes a one-way valve to prevent back flow. An intake line is connected to the wand leading back to the pump. The length of the intake line can vary allowing the water bottle to be remotely located providing means to conceal the bottled water in an adjacent area or other area of convenience.

An additional element of the present invention includes a bottled water pump with auxiliary water tap. With an auxiliary water tap present, activating the handle to an open position will close a switch turning on the pump to release water from the bottle water in lieu of the temperature controlled water of the water cooler reservoir. For a water cooler unit that does not include such feature, this additional element provides the convenience of room temperature water from the bottled water.

Another additional element of the present invention includes a bottled water pump with audio alert(s) connected to the no flow switch and/or over flow switch. Activation of either the no flow water switch or over flow switch closes the audio alert circuit and an alarm is sounded. This additional element enables the user to timely replace an empty water bottle or react to an over flow situation quickly and prevents water damage to the surrounding area.

Yet another additional element of the present invention includes a reserve battery pack. This additional element enables the user to maintain use of the bottled water pump in the event of AC power failure, or non-electric use.

Still yet another additional element of the present invention includes a free floating mercury switch. When present, the free floating mercury switch replaces both the low water and high water float switches. This enhancement reduces the number of switches required, and thus reduces the chance of switch failure.

DESCRIPTION OF THE PRIOR ART

There are other water cooler pump systems. Typical of these is U.S. Pat. No. 3,179,292 issued W. B. Terry on Apr. 20, 1965.

A patent was issued on Aug. 30, 1966 as U.S. Pat. No. 3,269,143 to M. Gasparovich. Another patent was issued to W. C. Moreland II, et al., on Feb. 17, 1970 as U.S. Pat. No. 3,495,612. Yet another U.S. Pat. No. 4,030,634 was issued to David R. Osborn on Jun. 21, 1977 and still yet another was issued on May 8, 1979 to Wallace J. Parker et al., as U.S. Pat. No. 4,153,181.

U.S. Pat. No. 4,174,743 was issued to Janos Beny et al. on Nov. 20, 1979. Another patent was issued to Mark W. Hancock et al. on Mar. 26, 1991 as U.S. Pat. No. 5,002,201. Yet another U.S. Pat. No. 5,495,725 was issued to William Middlemiss on Mar. 5, 1996 and still yet another was issued to Mark W. Hancock et al., on Jul. 30, 1996 as U.S. Pat. No. 5,540,355.

Another patent was issued to Terry J. Todden et al., on Jun. 17, 1997 as U.S. Pat. No. 5,638,991. U.S. Pat. No. 5,842,603 was issued on Dec. 1, 1998 to Alfed A. Schroeder et al., and on Feb. 6, 2001 Sijtze Van Der Meer et at, was issued U.S. Pat. No. 6,182,863.

U.S. Pat. No. 3,179,292

Inventor: W. B. Terry

Issued: Apr. 20, 1965

This invention relates to water coolers. The object of this invention is to provide means by which a water cooling cabinet may provide and utilized in a location not serviced by utility water outlets and drains. The water cooler of the invention carries its own water supply which may be replenished from time to time and necessitates only a source of electrical potential for actuating the motor for its pump means and the motor for its refrigeration unit.

U.S. Pat. No. 3,269,143

Inventor: M. Gasparovich

Issued: Aug. 30, 1966

This invention relates to a self-contained liquid dispenser. The object of this invention is to provide a cabinet having a compartment in the lower portion there-of and adapted to receive a removable liquid reservoir.

U.S. Pat. No. 3,495,612

Inventor: W. C. Moreland II, et al.

Issued: Feb. 17, 1970

This invention relates to a water pumping and control system. The object of this invention is the provision of a pumping system in which the suction side of the pump normally draws air from the dispensing reservoir until the desired level of water is reached in the dispensing reservoir, at which time water is drawn into the pump.

U.S. Pat. No. 4,030,634

Inventor: David R. Osborn

Issued: June 21, 1977

A device for transferring water from a standard five gallon water bottle to a dispenser spout, without the need for lifting the bottle and inverting it atop the dispenser, comprises a bottle pressurizing agent, ducting to carry water from the bottle to the dispenser and various control sensor and indicator means to control pressurant and water flow so that potable water from the dispenser is available on demand.

U.S. Pat. No. 4,153,181

Inventor: Wallace J. Parker et al.

Issued: May 8, 1979

A unit for dispensing water from a bottle. The parts of the unit include an air pump for pressurizing the bottle, a microswitch having a control button connected in circuit with the pump, a small pressure chamber with a distensible diaphragm for a top, a branched air line connecting the pump with the bottle and the pressure chamber, and a cabinet with rollers that can be rolled to a position of use around the upright bottle. Additionally, the unit includes a water line positioned to extend upwardly away from the bottle. A rubber cap encloses the bottle opening and the water line and a branch of the air line are in communication with the interior of the bottle by means of metal tubes passing through the cap. Fastened to the lower end of the metal tube for the water line is a section of flexible tubing long enough to reach to the bottom of the bottle. The microswitch is normally closed and the pressure chamber is positioned with its diaphragm close to the control button of the switch. When the air pressure in the bottle exceeds a certain limit, the diaphragm bulges outwardly into contact with the button and opens the microswitch. When water is drawn from the bottle through the water line, the air pressure drops, and the diaphragm shrinks away from the control button. This causes the microswitch to close and start the air pump operating to again build up air pressure in the bottle.

U.S. Pat. No. 4,174,743

Inventor: Janos Beny et al.

Issued: Nov. 20, 1979

An integrated apparatus or device for transferring, that is, pumping water front a water bottle to a water fountain having a reservoir with a dispensing faucet. A housing is provided carrying a stopper for insertion into the neck of a water bottle. Within the housing, there is a pump; a tube is connected to the pump discharge and extends through the stopper for pumping air into the bottle. A further tube passes through the stopper for transferring water from the bottle. The other end of this tube extends to fitting means which can be placed on the reservoir in a position normally occupied by the water bottle in an inverted position. This fitting carries a float valve which closes the end of the supply tube when the reservoir is filled.

U.S. Pat. No. 5,002,201

Inventor: Mark W. Hancock et al.

Issued: Mar. 26, 1991

A water dispensing system and method for carbonating water from a bottled water supply includes a carbonator that is controlled by electrical components which are coupled to fluid lines associated with the carbonator for remotely controlling the liquid level in the carbonator in response to the volumetric absorption of carbon dioxide in water.

U.S. Pat. No. 5,495,725

Inventor: William Middlemiss

Issued: Mar. 5, 1996

A water transport system replaces the inverted water bottle on a conventional bottled water cooler of the type with a refrigerated, open top water reservoir. The system automatically transfers water from an upright water bottle below the reservoir into the reservoir whenever water in the reservoir falls below a predetermined level. A water pipe carries water from the bottle, through a sealed closure in the bottle neck and up into the reservoir whenever air pressure in the bottle is elevated. An air pump in a housing atop the reservoir generates air pressure in an air tube passing through the closure and into the bottle. A water level sensor reduces air pressure in the system when the water in the reservoir reaches a predetermined level to thereby automatically control refilling of the reservoir.

U.S. Pat. No. 5,540,355

Inventor: Mark W. Hancock et al.

Issued: July 30, 1996

A water cooler and dispensing system comprises a housing, a pump, a cap, a siphon tube, a reservoir, a cooling unit, control circuitry and a faucet. The housing includes a frame and detachable panels for supporting the reservoir above a water bottle. The cap substantially seals the bottle and is coupled to the pump. The pump forces air into the bottle and water upward through the siphon tube to the reservoir. A liquid pumping system may also be used. The reservoir is divided into two portions, and the lower portion contains a cooling unit for chilling the water. The reservoir has an output port from each portion of the reservoir coupled to a faucet formed by a manifold, two valves and a nozzle. The dispenser also includes control circuitry for selectively operating the pump to maintain a predetermined water level in the reservoir. The controller also lights an indicator when the bottle is empty.

U.S. Pat. No. 5,638,991

Inventor: Terry J. Todden et al.

Issued: June 17, 1997

A bottled water dispenser is similar in size to those available on the market today. An upright five gallon bottle slides onto a dolly and is held fast to the dolly by a stretch cord. The dolly with bottle is wheeled into the bottom of the dispenser. Alternately, the dispensing systems may be assembled upon the dolly itself. A tube with a rubber stopper at one end and a check valve at the other end is inserted into the bottle. Pushing a button on the face plate of the dispenser cabinet activates an internal electric pump. The pump draws water from the bottle through the check valve and forces it out of the spigot under pressure. Internal solenoid valves force the water through a heating unit, cooling unit or filtration system before exiting through the spigot. Each temperature is achieved by pushing a different colored button on the face plate. The dispenser operates on 240 V AC, 120 V AC or 12 V DC. It has a built in auxiliary battery back up in the event of power outages or for portable use. The dispenser can be mobile on wheels, free standing, or built into a kitchen cabinet.

U.S. Pat. No. 5,842,603

Inventor: Alfred A. Schroeder et al.

Issued: Dec. 1, 1998

A postmix juice dispenser for use with a disposable juice concentrate package that includes an integral progressive cavity pump and a mixing nozzle. The dispenser can read a product I.D. label on the package to automatically change ratios as packages are switched and a low liquid level indicator in the package to both warn the operator and to then provide automatic shut-off. A controller adjusts the pump motor speed in response to signals from a water flow meter to provide excellent control of ratio, even as water pressure changes. An easy lift-out refrigeration deck is located over an ice-water bath tank capable of holding 27 pounds of ice.

U.S. Pat. No. 6,182,863

Inventor: Sijtze Van Der Meer et al.

Issued: Feb. 6, 2001

A beverage dispensing apparatus is provided which includes a housing having a chamber in which a beverage container can be placed, the container having at least one deformable wall and an outlet to which a beverage delivery line and a tapping device can be connected, a locking and sealing mechanism for closing a pressure space in an airtight manner, which pressure space is situated between an outer wall of the beverage container and an inner wall of the chamber, and a pressurizing device for pressurizing the pressure space to force beverage out of the container via the outlet. To improve the sealing and locking and to make the apparatus convenient to operate for the user the locking and sealing mechanism is arranged between the outer wall of the beverage container and a wall of the chamber.

While these water cooler pump systems may be suitable for the purposes for which they were designed, they would not be as suitable for the purposes of the present invention, as hereinafter described.

SUMMARY OF THE PRESENT INVENTION

The present invention discloses a pump system that can be added to an existing water cooler or be an integral system that includes the water reservoir, cooling and pumping systems. When added to an existing water cooler system the base of the present invention is placed over the water cooler reservoir. A gasket provides means to seal the top of the water cooler reservoir and prevent possible contamination. A power switch provides means to turn the pump on and off. The low-level switch is positioned at a desired level in the water cooler reservoir to prevent water run out. When the water level in the water cooler reservoir is below the low-level float switch the pump is turned on, and upon reaching the high water switch, the pump is turned off. In event of the high water switch malfunctioning, an over flow switch is utilized as a safety mechanism to shut off the pump. The water bottle is connected to the pump by means of a wand and intake line. The intake line includes an accordion pump to prime the line and protect against air lock. A plug, tapered to fit the various sizes of water bottle openings, is affixed to the top opening of the water bottle. An air valve is contained within the plug to provide air displacement when the water is withdrawn. A second aperture in the plug allows the wand to be inserted through the plug to a depth just above the bottom of the bottle. A no water flow switch is located at the end of the wand shuts off the pump upon sensing no water indicating an empty water bottle. The opposite end of the wand includes a one-way valve to prevent back flow. An additional element of the present invention includes a bottled water pump with auxiliary water tap. Another additional element of the present invention includes a bottled water pump with audio alert(s) connected to the no-flow switch and/or overflow switch. Yet another additional element of the present invention includes a reserve battery pack. Still yet another additional element of the present invention includes a free-floating mercury switch to replace the low and high level switch.

A primary object of the present invention is to provide a water cooler pump that dispenses water from a bottle in an upright position into a water cooler reservoir.

Another object of the present invention is to provide a water cooler pump that has means to detect low water level in the water cooler reservoir.

Still another object of the present invention is to provide a water cooler pump that dispenses water from the water bottle into the water cooler reservoir upon a low water level condition.

Yet another object of the present invention is to provide a water cooler pump that has means to detect high water level in the water cooler reservoir.

Still another object of the present invention is to provide a water cooler pump that stops water from flowing from the water bottle into the water cooler reservoir upon a high water level condition.

Another object of the present invention is to provide a water cooler pump that includes water over flow protection and stops water from flowing from the water bottle into the water cooler reservoir upon a high water level condition.

Yet another object of the present invention is to provide a water cooler pump that includes means to prevent back flow of water from the water cooler reservoir to the water bottle.

Still another object of the present invention is to provide a water cooler pump that includes means to audio alert a user of a water cooler reservoir over flow condition.

Yet another object of the present invention is to provide a water cooler pump that includes means to audio alert a user of a bottle out of water condition.

Additional objects of the present invention will appear as the description proceeds.

The present invention overcomes the shortcomings of the prior art by providing an improved means to protect the user from muscle pulls and strains associated with the lifting the bottled water. As well as providing means to protect against over-flow conditions and water damages caused by faulty pumps or switches.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
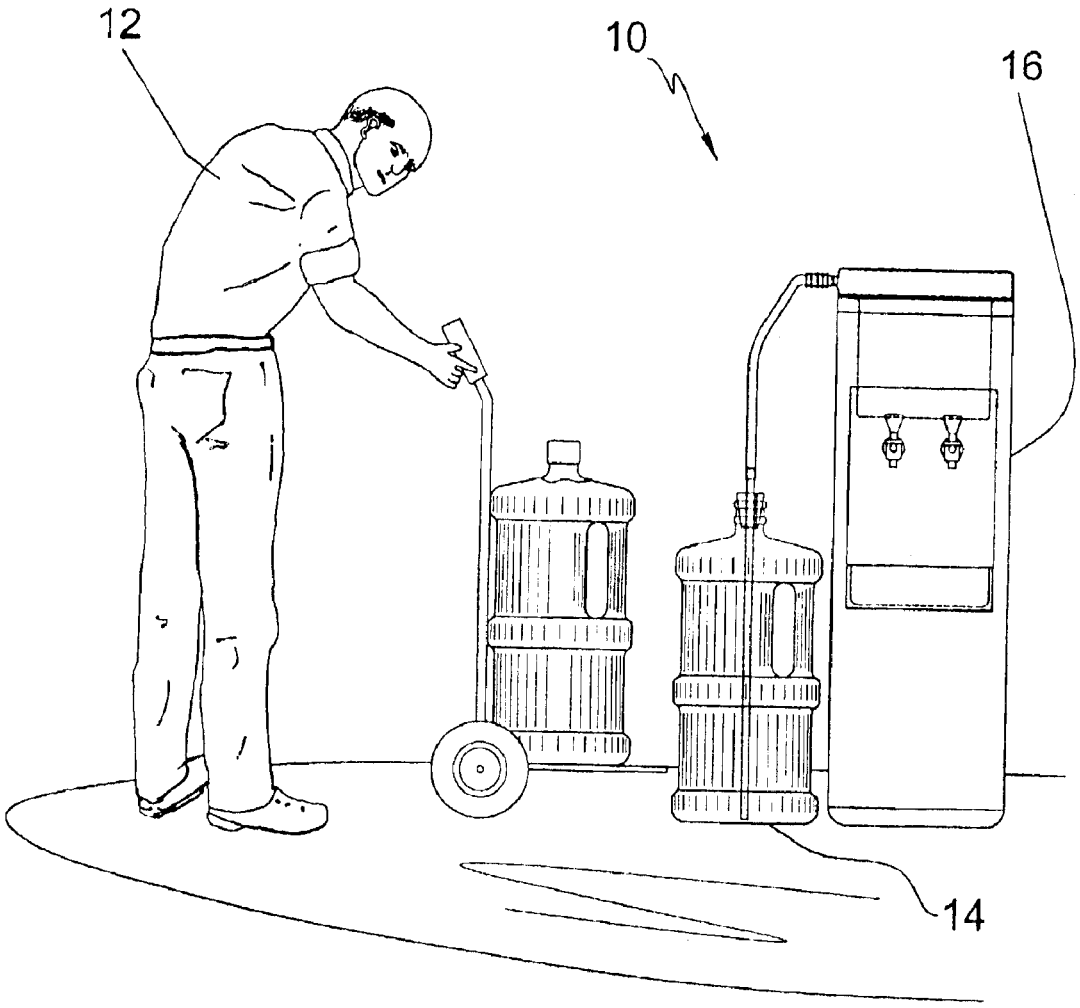
FIG. 1 is an illustrative view of the present invention's bottled water pump.

With regard to reference numerals used, the following numbering is used throughout the drawings.

10 present invention
12 user
14 empty bottle
15 bottle of water
16 water cooler
18 prior all water cooler
20 water bottle of prior art
22 reservoir
24 pump
26 low level switch
28 high level switch
30 overflow switch
32 power cord
34 power switch
36 accordion pump
38 intake line
40 gasket
42 feed line
44 hanger
46 plug
48 air valve
50 one way valve
52 no water flow switch
54 wand
56 clamp
58 line voltage
60 adjacent area
62 auxiliary tap
64 handle
66 audio alert
68 auxiliary tap switch
70 audio alarm
72 battery pack
74 free-floating mercury switch

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. As consumers become less confident in utilizing tap water for consumption, bottled water has become increasingly popular. The present invention 10 enables users of bottled water to have an improved means to displace the water from the water bottle to the water cooler reservoir. Depicted in FIG. 1 is a user 12 that would have difficulties with prior art preparing to replace the empty bottled water 14 on water cooler 16 utilizing the present invention 10 bottled water pump.

Figure 2:
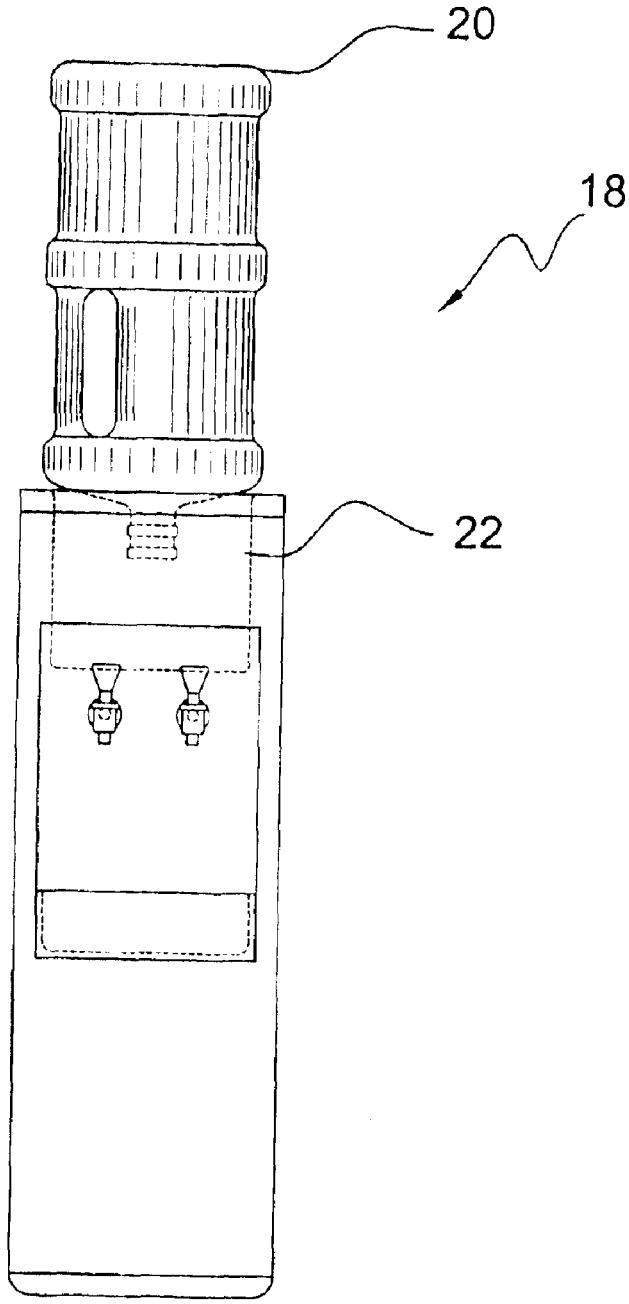
FIG. 2 is a front view of bottled water cooler prior art.

Turning to FIG. 2, shown therein is a front view of bottled water cooler prior art 18. In the prior art, the method of displacing the water from the water bottle 20 to the water cooler 18 reservoir 22 requires the user to lift a full five gallon bottle 20 and rotate the bottle opening into the water cooler reservoir 22. Such a task can be difficult requiring strength that many people do not have and possibly causing spillage of the bottled water. The method of the present invention eliminates the need to lift and rotate the water bottle 20 to replenish the water cooler reservoir 22.

Figure 3:
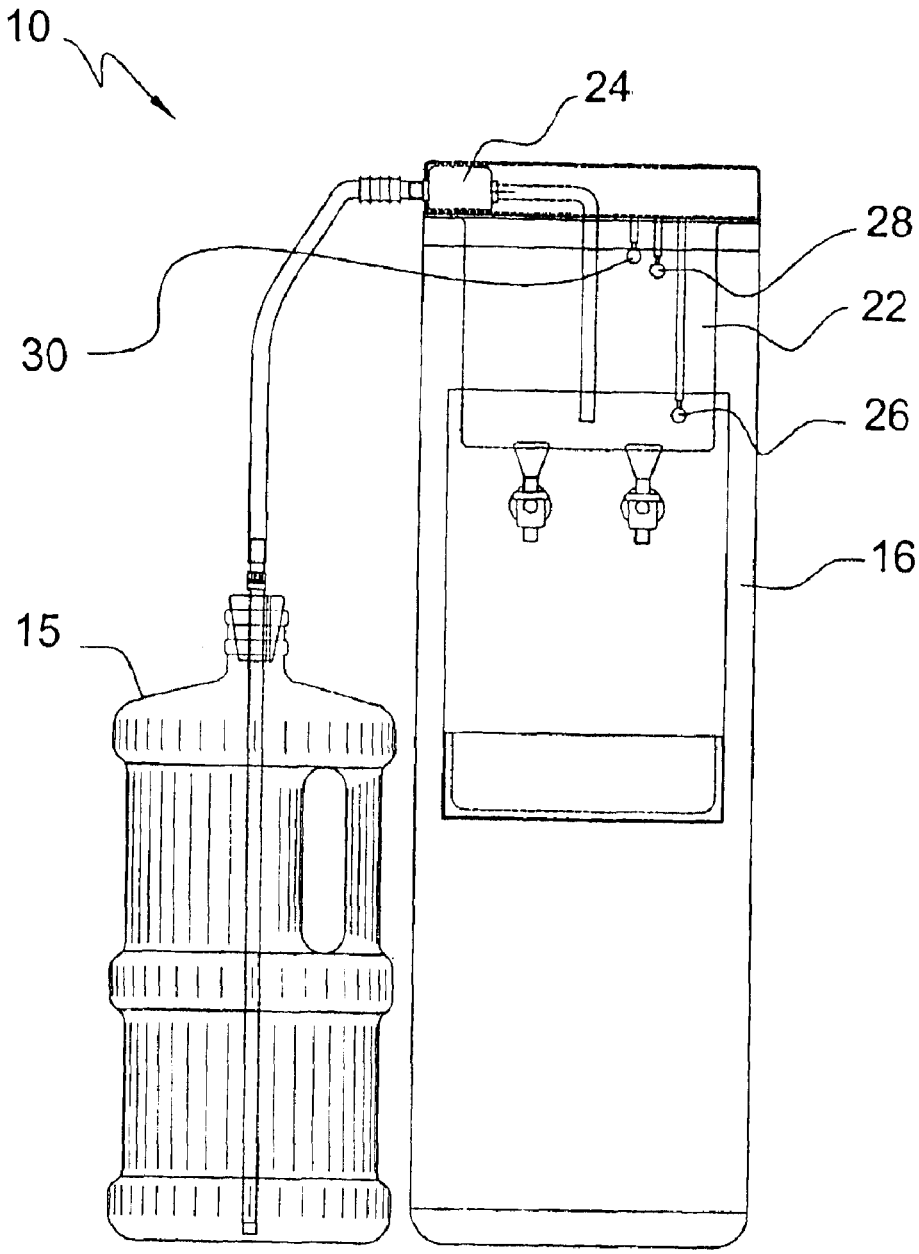
FIG. 3 is a front view of the present invention's bottled water pump in use.

Turning to FIG. 3, shown therein is a front view of the bottled water pump 24 of the present invention 10 in use whereby a bottle 15 of water is placed on a support surface and is connected to a water cooler 16. The low-level float switch 26 is positioned at a preselected desired level in the water cooler reservoir 22 to prevent running out of water. When the water level in the water cooler reservoir 22 is below the low-level float switch 26 the pump 24 is turned on, and upon the water level reaching the high water float switch 28, the pump 24 is turned off. In event of the high water switch 28 malfunctioning, an overflow float switch 30 is utilized as a safety mechanistic to shut oft the pump 24.

Figure 4:
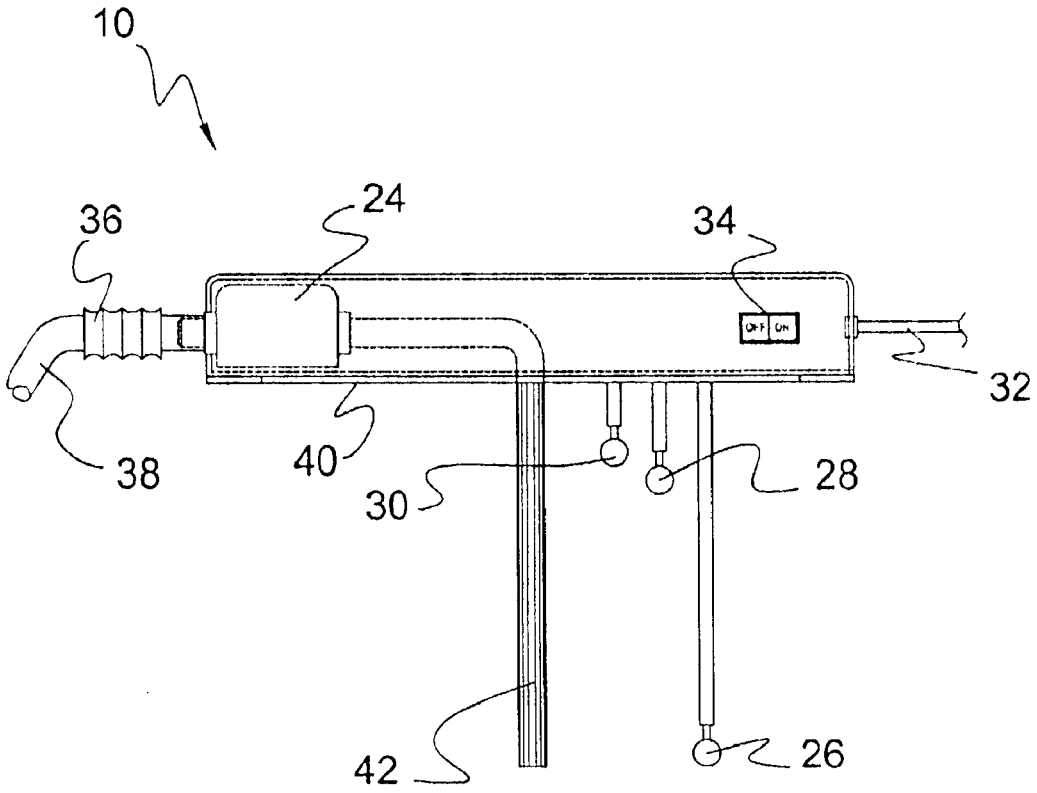
FIG. 4 is a front view of the present invention's bottled water pump.

Turning to FIG. 4, shown therein is a front view of the bottled water pump 24 of the present invention 10. The present invention 10 provides means to disable and control the pump 24 by power cord 32 and power switch 34. Both must be enabled for the pump 24 to function. An accordion pump 36 is used to prime the intake line 38 from the water bottle to protect against air lock. Also shown is gasket 40 which seals around the top of the reservoir, water input feed line 42, low level switch 26, high level switch 28, and overflow switch 30.

Figure 5:
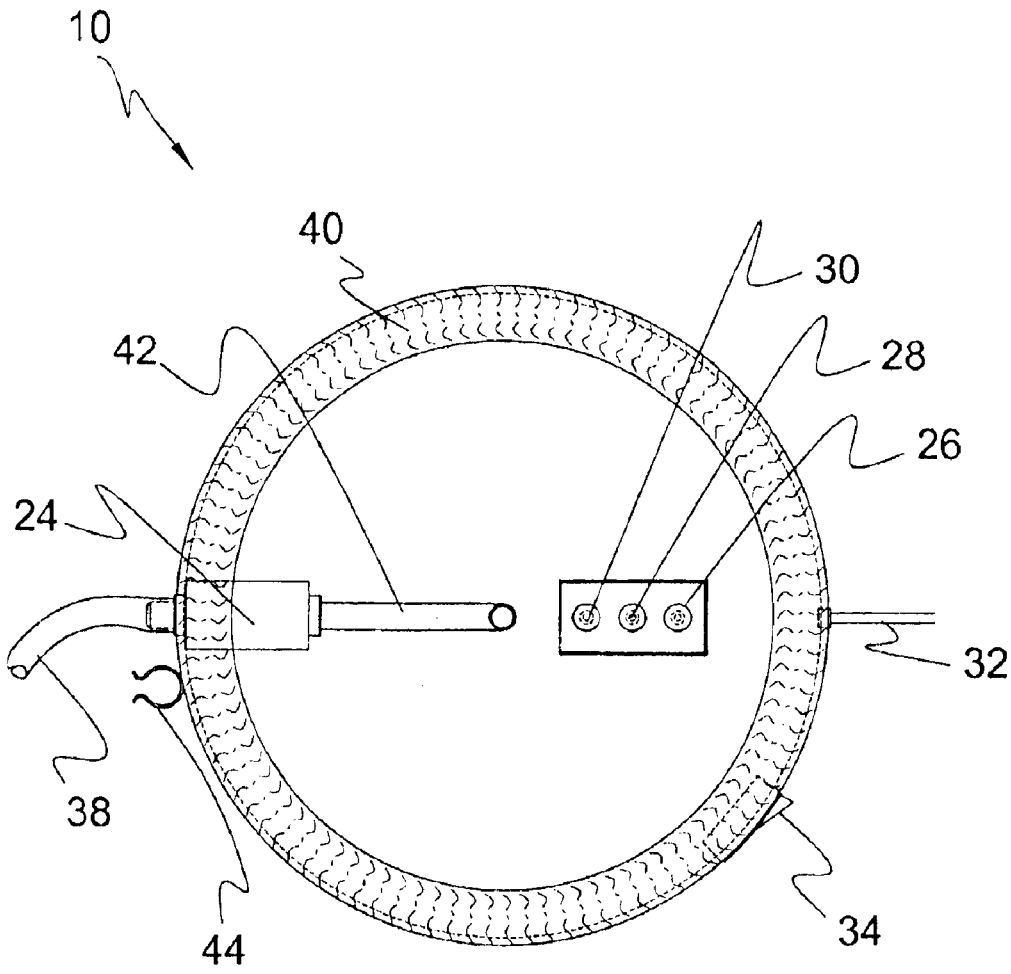
FIG. 5 is a bottom view of the present invention's bottled water pump.

Turning to FIG. 5, shown therein is a bottom view of the bottled water pump 24 of the present invention 10. A gasket 40 provides means to seal the top of the water cooler reservoir and prevent possible contamination. A hanger 44 provides a means to place the water wand when not in use. Also shown are low level switch 26, high level switch 28, overflow switch 30, power cord 32, power switch 34, intake line 38 and feed line 42.

Figure 6:
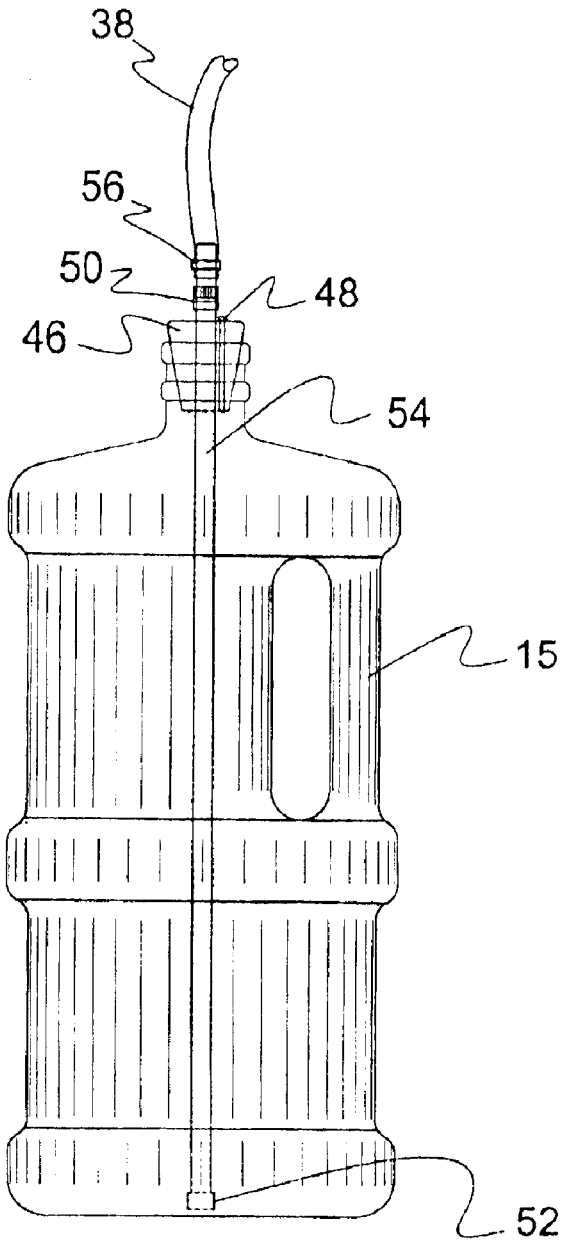
FIG. 6 is a side view of the present invention's water bottle seal connection.

Turning to FIG. 6, shown therein is a side view of the water bottle 15 leakproof connection of the present invention 10. The plug 46 is tapered to fit the various sizes of water bottle openings and provides a seal to protect from contamination. An air valve 48 is contained within the plug 46 to provide air displacement when the water is withdrawn. A one-way valve 50 provides means to protect against water backflow. A no water flow switch 52 located at the end of the wand 54 shuts off the pump upon sensing that no water is available indicating an empty water bottle 15. Intake line 38 is attached to the one-way valve 50 with clamp 56.

Figure 7:
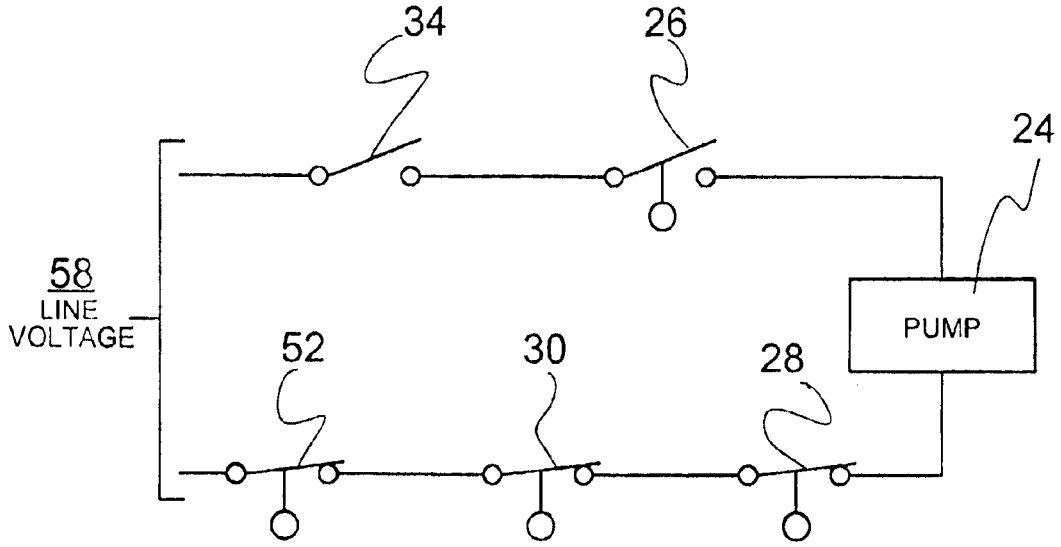
FIG. 7 is a wiring diagram of the present invention's bottled water pump.

Turning to FIG. 7, shown therein is a wiring diagram of parts of the present invention. The power switch 34 must be on to enable the pump 24. When the water level in the water cooler reservoir is below the low-level float switch 26 the pump 24 is turned on, and upon the water level reaching the high water switch 28, the pump 24 is turned off. In event of the high water switch 28 malfunctioning, an overflow switch 30 is utilized as a safety mechanism to shut off the pump 24. A no water flow switch 52 shuts the pump 24 upon sensing a no water condition indicating an empty water bottle. A line voltage source 58 is also indicated.

Figure 8:
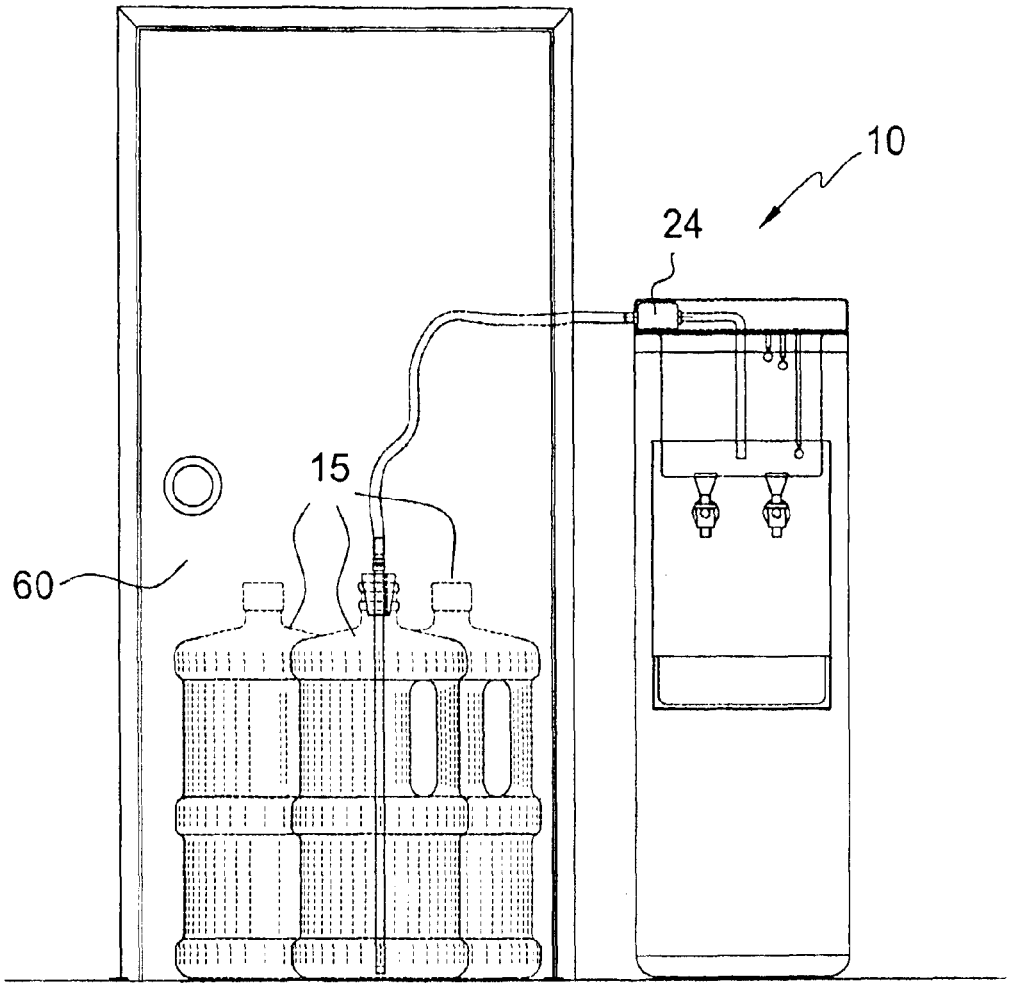
FIG. 8 is an illustrative view of the present invention's bottled water pump in a remote location.

Turning to FIG. 8, shown therein is an illustrative view of the present invention 10 showing the bottles of water 15 for use with the bottled water pump 24 in a remote location. The present invention 10 provides means to conceal the bottled water in an adjacent area 60.

Figure 9:
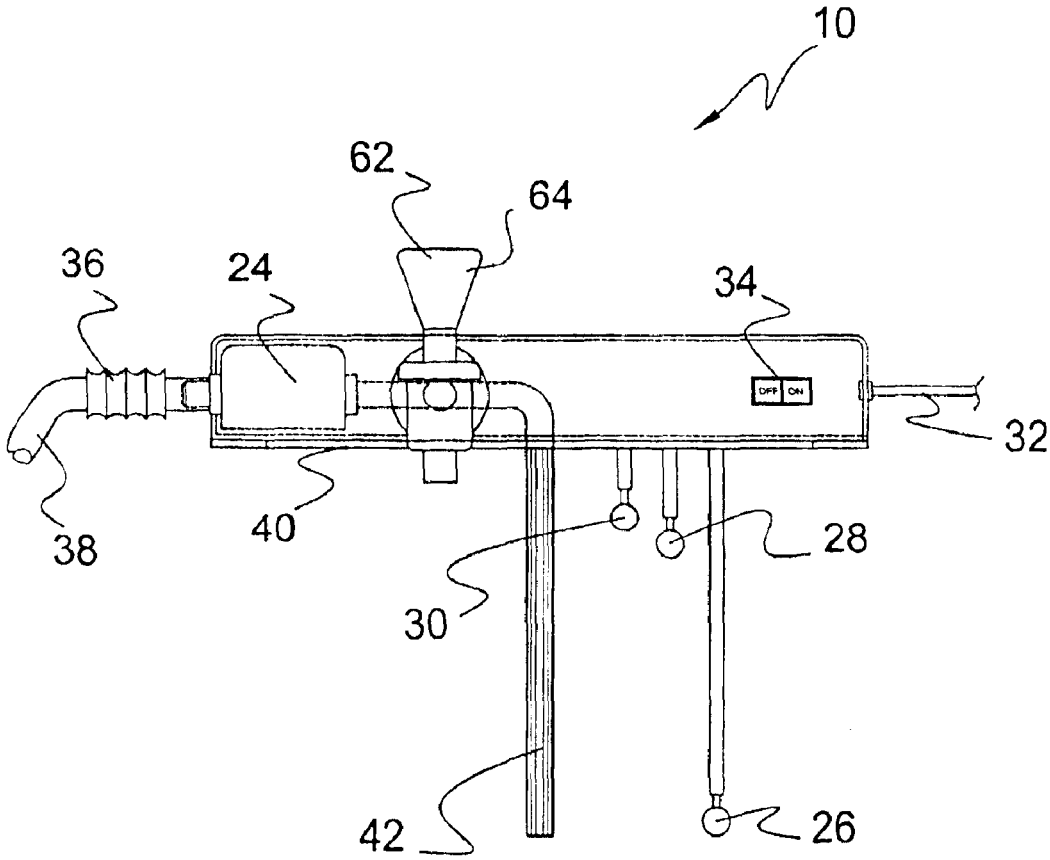
FIG. 9 is a front view of the present invention's bottled water pump with the additional element of an auxiliary tap.

Turning to FIG. 9, shown therein is a front view of the bottled water pump 24 of the present invention 10 with the additional element of an auxiliary water outlet tap 62. With an auxiliary tap 62 present on the pump output or feed line 42, activating the handle 64 to an open position will close a switch turning on the pump 24 to release water through the auxiliary tap 62. For a water cooler unit that does not include room temperature water dispensing, this additional element provides the convenience of room temperature water from the bottled water of the present invention. Other previously disclosed elements are also shown.

Figure 10:
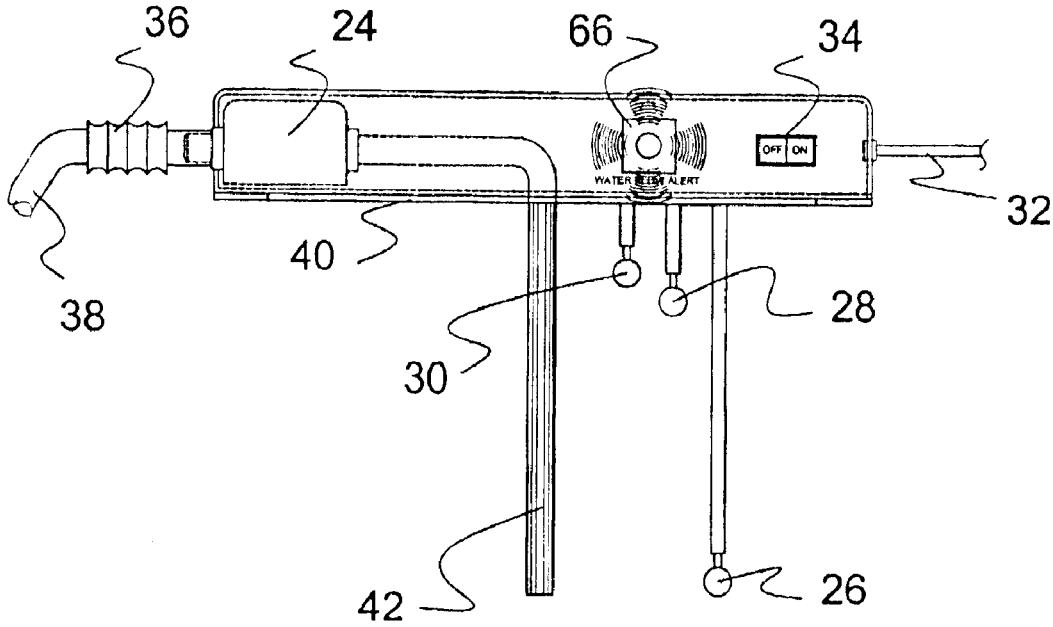
FIG. 10 is a front view of the present invention's bottled water pump with the additional element of an audio alert.

Turning to FIG. 10, shown therein is a front view of the bottled water pump 24 of the present invention 10 with the additional element of an audio alert 66. Activation of either the no flow water switch or overflow switch 30 closes the audio alert 66 circuit and an alarm is sounded. This additional element 66 enables the user to replace an empty water bottle or react to an over flow situation quickly and prevents water damage to the surrounding area. Other previously disclosed elements are also shown.

Figure 11:
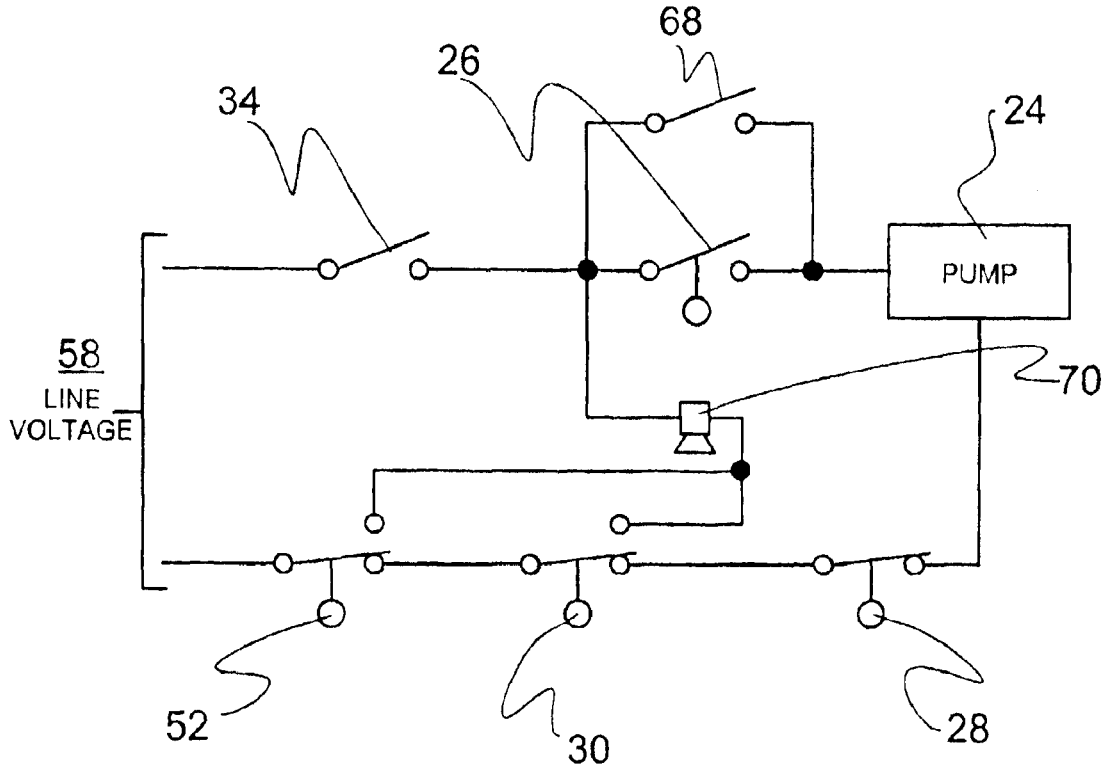
FIG. 11 is a wiring diagram of the present invention's bottled water pump with additional elements.

Turning to FIG. 11, shown therein is a wiring diagram of the bottled water pump 24 of the present invention 10 with additional elements. With an auxiliary tap present, activating the handle to an open position will close a switch 68 to turn on the pump 24 to release water through the auxiliary tap. With a no flow and/or over flow audio alert present, activation of either the no flow 52 or overflow switch 30 closes the audio alert circuit and an audio alarm 70 is sounded. Other previously disclosed elements are also shown.

Figure 12:
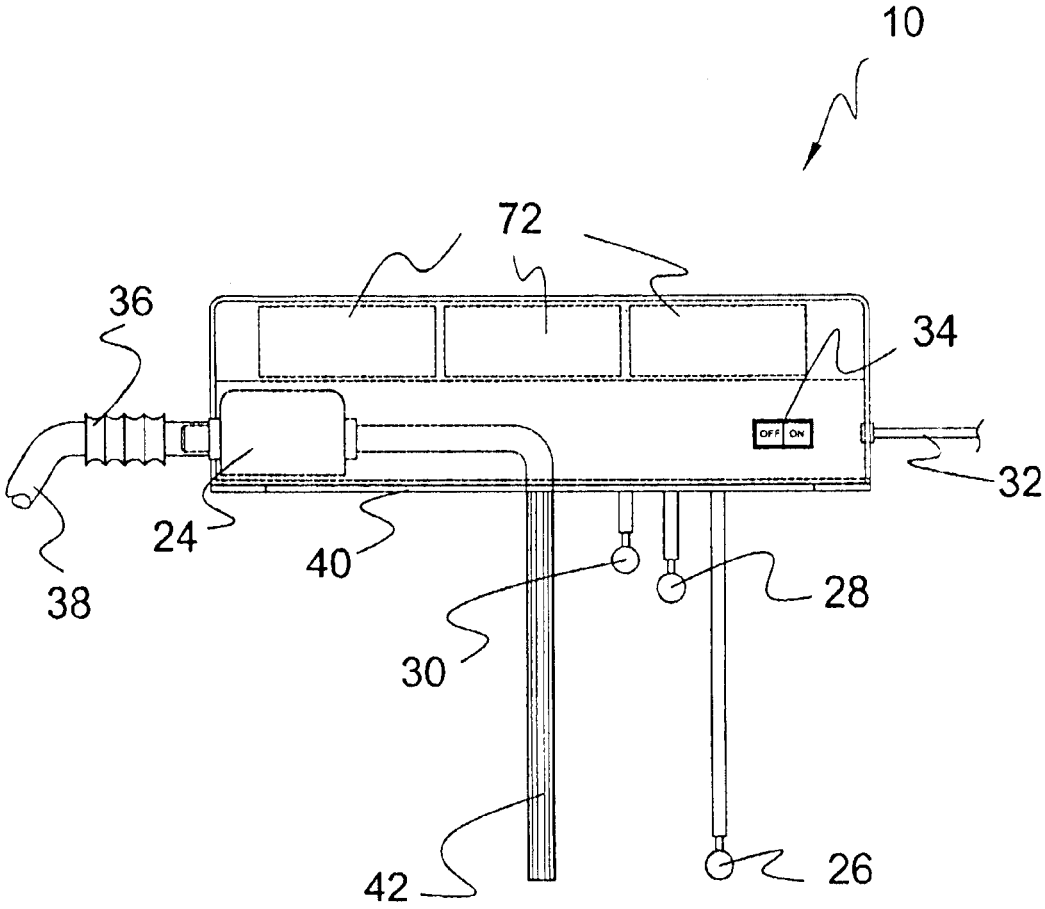
FIG. 12 is a front view of the present invention's bottled water pump with a battery pack as an additional element.

Turning to FIG. 12, shown therein is a front view of the bottled water pump 24 of the present invention 10 with a battery pack 72 as an additional element. This additional element enables the user to maintain use of the bottled water pump 24 in the event of ac power failure, or non-electric use. Other previously disclosed elements are also shown.

Figure 13:
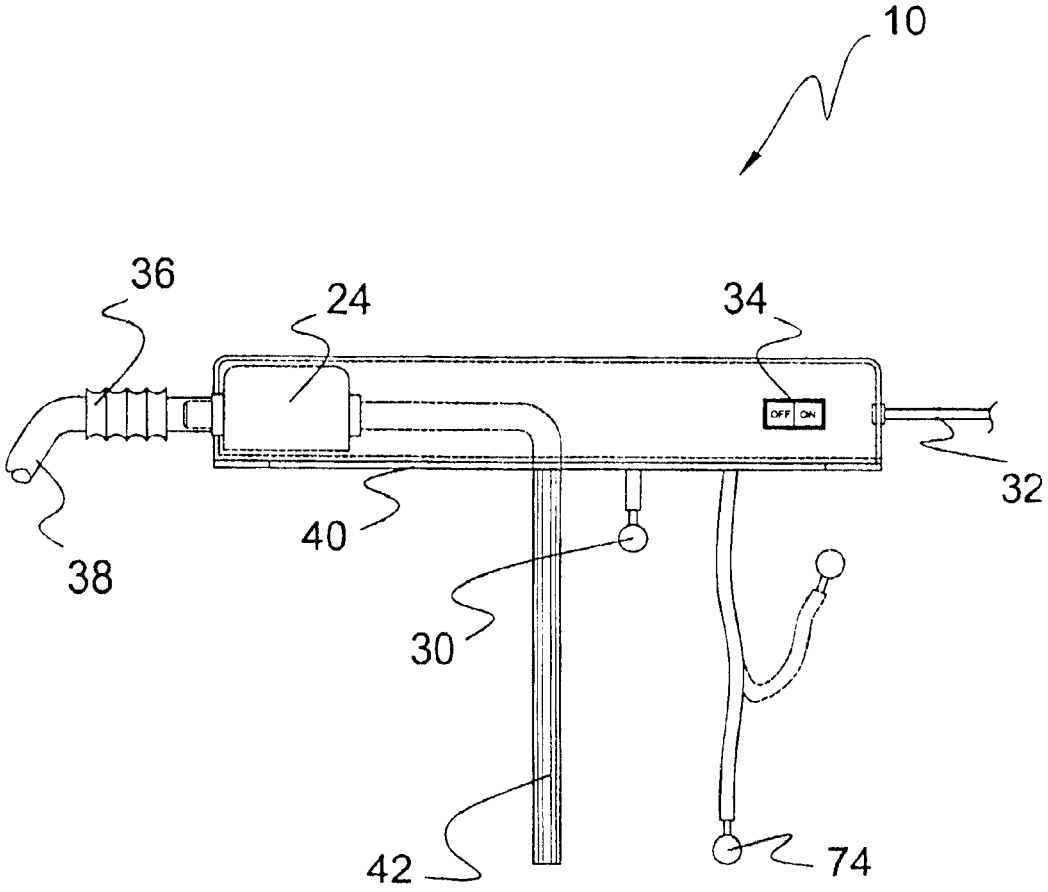
FIG. 13 is a front view of the present invention's bottled water pump with a free floating mercury switch as an additional element.

Turning to FIG. 13, shown therein is a front view of the bottled water pump 24 of the present invention 10 with a free-floating mercury switch 74 as an additional element. Depicted is the present invention 10 utilizing a free-floating mercury switch 74 in lieu of the high and low water float switches. This option of water control reduces the number of switches required, and thus reduces the chances of mechanical failure. Other previously disclosed elements are also shown.

What is claimed to be new and desired to be protected by Letters Patent is set forth in the appended claims.

I claim:

1. An apparatus for pumping water from a water bottle to a bottled water cooler, comprising:

a) a bottled water cooler having a water reservoir therein wherein said water reservoir receives water from a bottle of water, said water bottle being complimentarily sized for use with said water cooler, said water reservoir having at least one outlet tap from which tap a user can obtain water from the bottle of water, said bottled water cooler having a top end and a bottom end, said reservoir having a top end and a bottom end, said bottle having a top end and a bottom end;

b) a housing for containing said bottled water cooler, said housing having a top end and a bottom end;

c) means for pumping water from said bottle of water to said water reservoir whereby water is pumped from the bottle of water to the water reservoir in the bottled water cooler; and, d) means for controlling said means for pumping water whereby the flow of water from the bottle of water to the water reservoir is automatically controlled;

e) an accordion pump disposed in said intake line to permit the means for pumping to be primed, means for connecting an intake line to the bottle of water, comprising:

i) an elongated wand disposed in said bottle to permit water to be withdrawn from the bottle, said wand having a first end and second end, said intake line being connected to said first end of said wand;

ii) a plug disposed in the bottle neck to provide a leakproof connection, said plug having a pair of apertures therein wherein said wand passes through a first aperture;

iii) an air valve disposed in said second aperture to permit water to flow freely from the bottle; and, iv) a one-way valve disposed in said first end of said wand to prevent water from flowing backward into the bottle; and said mean for controlling said means for pumping comprises:

i) an on/off switch for turning said pump on or off;

ii) a low level switch disposed in the bottom of said reservoir to activate said pump when the water level is near the bottom of the reservoir;

iii) a high level switch disposed in the top of said reservoir to deactivate said pump when the water level is near the top of the reservoir;

iv) an overflow level switch disposed in the top of said reservoir to deactivate said pump when the water level is near the top of the reservoir if said high level switch fails; and, v) a no water level switch disposed in the bottom of said bottle to deactivate said pump when the water level is near the bottom of the bottle.

2. The apparatus of claim 1, wherein said means for pumping water comprises:

a) a pump, wherein said pump is electrically powered;

b) an electrical power source for said pump;

c) said intake line for delivering water to the pump from the bottle of water;

d) a feed line for delivering water from the pump to the water reservoir; and, e) said means for connecting said intake line to the bottle of water.

3. The apparatus of claim 1, wherein said no water switch is disposed on said second end of said wand.

4. The apparatus of claim 3, further comprising an auxiliary water outlet tap disposed on said pump outlet, wherein use of said tap to provide water activates said pump to provide water from the bottle of water at room temperature prior to the water entering the water cooler.

5. The apparatus of claim 4, further comprising an audio alarm which sounds when either said overflow switch or said no water switch is triggered by the corresponding water level.

6. The apparatus of claim 5, wherein said electrical power source for said pump is a battery power source to permit use of the apparatus in the event of an alternating current power failure.

7. The apparatus of claim 6, wherein said means for pumping water and said means for controlling said means for pumping are disposed in an enclosure, wherein said enclosure is disposed on said top of said housing to permit the means for pumping water and means for controlling the means for pumping to be retrofitted to an already existing bottled water cooler.

8. The apparatus of claim 7, further comprising a gasket being disposed between said enclosure and said housing to permit a water tight seal therebetween.

9. The apparatus of claim 7, further comprising a hanger being disposed on said housing side to permit the wand to be attached to the hanger when the wand is not in use.

* * * * *